US007597859B2

(12) United States Patent
Brück et al.

(10) Patent No.: US 7,597,859 B2
(45) Date of Patent: Oct. 6, 2009

(54) EXHAUST GAS SYSTEM WITH TWO EXHAUST GAS TREATMENT UNITS

(75) Inventors: Rolf Brück, Bergisch Gladbach (DE); Andreas Scheeder, Siegburg (DE)

(73) Assignee: Emitec Gesellschaft fuer Emissionstechnolgie mbH, Lohmar (DE)

( * ) Notice: Subject to any disclaimer, the term of this patent is extended or adjusted under 35 U.S.C. 154(b) by 0 days.

(21) Appl. No.: 11/859,873

(22) Filed: Sep. 24, 2007

(65) Prior Publication Data

US 2008/0008631 A1 Jan. 10, 2008

Related U.S. Application Data

(63) Continuation of application No. PCT/EP2006/002488, filed on Mar. 17, 2006.

(30) Foreign Application Priority Data

Mar. 24, 2005 (DE) ..... 10 2005 014 265

(51) Int. Cl.
*B01D 39/00* (2006.01)
*B01D 39/06* (2006.01)
*B01D 39/14* (2006.01)
*B01D 50/00* (2006.01)

(52) U.S. Cl. ..... 422/177; 55/522; 55/523; 55/524

(58) Field of Classification Search ..... 55/522–524; 422/177

See application file for complete search history.

(56) References Cited

U.S. PATENT DOCUMENTS 3,978,567 A * 9/1976 Vroman ..... 29/890
4,900,517 A * 2/1990 Domesle et al. ..... 422/171

(Continued)

FOREIGN PATENT DOCUMENTS

DE 4024942 A1 2/1992

(Continued)

OTHER PUBLICATIONS

English translation of patent EP1010462.*

(Continued)

*Primary Examiner*—Walter D Griffin
*Assistant Examiner*—Amber Orlando
(74) *Attorney, Agent, or Firm*—Laurence A. Greenberg; Werner H. Stemer; Ralph E. Locher

(57) ABSTRACT

An exhaust gas system for an internal combustion engine includes a first exhaust treatment unit with a first back pressure and a second exhaust treatment unit with a second back pressure being higher than the first back pressure. The system advantageously enables the configuration of systems having two exhaust treatment units that are disposed one behind the other in flow direction. The first and/or second exhaust treatment unit can have a smaller construction due to the homogenization of flow. This applies, for example, when an oxidation-type catalytic converter is provided as the first exhaust treatment unit and when a particulate filter is provided as the second exhaust treatment unit. The homogenization of flow in the first exhaust treatment unit increases the conversion rate so that the first and/or second exhaust treatment unit can be provided with a smaller construction. This saves considerable costs when configuring such systems.

14 Claims, 2 Drawing Sheets

U.S. PATENT DOCUMENTS

| | | | | | |
|---|---|---|---|---|---|
| 5,272,875 | A | * | 12/1993 | Kaji | 60/299 |
| 5,328,774 | A | * | 7/1994 | Maus et al. | 428/593 |
| 5,591,413 | A | * | 1/1997 | Toyoda | 422/180 |
| 6,919,052 | B2 | * | 7/2005 | Foster et al. | 422/179 |
| 7,247,185 | B2 | * | 7/2007 | Jobson et al. | 55/523 |
| 2005/0008548 | A1 | | 1/2005 | Nakatani et al. | |
| 2005/0138907 | A1 | | 6/2005 | Jobson et al. | |
| 2005/0229590 | A1 | | 10/2005 | Bruck et al. | |
| 2006/0080953 | A1 | * | 4/2006 | Maus et al. | 60/286 |
| 2007/0028601 | A1 | * | 2/2007 | Duvinage et al. | 60/286 |
| 2007/0189936 | A1 | * | 8/2007 | Suwabe et al. | 422/177 |

FOREIGN PATENT DOCUMENTS

| | | | | |
|---|---|---|---|---|
| DE | 9210010.4 | U1 | | 10/1992 |
| DE | 0581190 | | * | 2/1994 |
| DE | 10003090 | A1 | | 7/2001 |
| DE | 10254764 | A1 | | 6/2004 |
| EP | 1010462 | | * | 6/2000 |
| EP | 1010462 | A1 | | 6/2000 |
| EP | 1496212 | A1 | | 1/2005 |
| JP | 62273049 | | | 11/1987 |
| JP | 63018123 | | | 1/1988 |
| JP | 63113112 | | | 5/1988 |
| WO | 9202716 | A1 | | 2/1992 |

OTHER PUBLICATIONS

English translation of patent EP0581190.*

* cited by examiner

EXHAUST GAS SYSTEM WITH TWO EXHAUST GAS TREATMENT UNITS

CROSS-REFERENCE TO RELATED APPLICATION

This is a continuing application, under 35 U.S.C. § 120, of copending International Application No. PCT/EP2006/002488, filed Mar. 17, 2006, which designated the United States; this application also claims the priority, under 35 U.S.C. § 119, of German Patent Application DE 10 2005 014 265.6, filed Mar. 24, 2005; the prior applications are herewith incorporated by reference in their entirety.

BACKGROUND OF THE INVENTION

Field of the Invention

The subject matter of the present invention is an exhaust gas system for internal combustion engines, having two exhaust gas treatment units.

Exhaust gas limiting values which have to be complied with by motor vehicles or even fixed internal combustion engines, are prescribed in many countries. There are often relatively complex limiting values for such systems in which, for example, not only a limiting value for one variable but rather a plurality of limiting values have to be complied with simultaneously. In order to comply with those limiting values, relatively complex conditioning processes of the exhaust gas are often necessary and those processes require a plurality of combined exhaust gas purification units.

For example, particle filters require regeneration in which particles of soot that are collected by the filter are burnt. That is done, for example, in the form of continuous regeneration (using a CRT or continuous regeneration trap) with nitrogen dioxide ($NO_2$). Since there is often insufficient nitrogen dioxide in the exhaust gas which flows into the filter, it is known to provide an oxidation catalytic converter upstream of the particle filter. That catalytic converter oxidizes nitrogen monoxide (NO) to form nitrogen dioxide ($NO_2$).

Another example is selective catalytic reduction (SCR) of nitrogen oxides ($NO_x$) in which it is necessary to supply a reducing agent, for example urea. The urea has to be hydrolyzed, so that a hydrolytic catalytic converter is often constructed upstream of an SCR catalytic converter in the direction of flow.

There are therefore a multiplicity of examples of systems which require two or more different exhaust gas treatment units that interact. All of those systems therefore have first and second exhaust gas treatment units located one behind the other in the direction of flow.

In all of those cases, a reaction rate which is as high as possible in the second exhaust gas treatment component generally requires conversion that is as efficient as possible in the first exhaust gas treatment component which is located upstream of the second exhaust gas treatment component in the direction of flow.

SUMMARY OF THE INVENTION

It is accordingly an object of the invention to provide an exhaust gas system with first and second exhaust gas treatment units, which overcomes the hereinafore-mentioned disadvantages of the heretofore-known devices of this general type and in which a reaction rate that is as high as possible is achieved in the second exhaust gas treatment component, while at the same time permitting a minimum possible overall volume of the exhaust gas treatment components.

With the foregoing and other objects in view there is provided, in accordance with the invention, an exhaust gas system for an internal combustion engine. The exhaust gas system comprises a first exhaust gas treatment unit with a first back pressure and a second exhaust gas treatment unit with a second back pressure being higher than the first back pressure. The first exhaust gas treatment unit is disposed at a first distance upstream of the second exhaust gas treatment unit, in exhaust gas flow direction, causing a gas flow entering the first exhaust gas treatment unit during operation to be homogenized. This means, in particular, that the back pressure upstream of the exhaust gas treatment unit in the direction of flow is influenced by the first back pressure of the heat exchanger.

The internal combustion engine is, in particular, a diesel engine or spark emission engine, for example a diesel engine or spark emission engine of a motor vehicle (for example of a passenger car, a truck, a motor-operated two wheeled vehicle, a boat or an aircraft) or a diesel engine or spark emission engine in a fixed application.

In particular, honeycomb bodies, for example ceramic or metallic honeycomb bodies or else wire mesh bodies, bodies made of metal foam or the like, are suitable as exhaust gas treatment units. Metallic honeycomb bodies can be constructed from at least one at least partially structured metallic layer and, if appropriate, at least one substantially smooth layer which are wound or stacked and twisted with one another. The layers which are twisted or wound with one another form cavities through which there can be a flow and which are bounded by the layers. The layers are constructed, in particular, from high-temperature-corrosion-resistant materials such as Al or Cr steel. The layers can be connected to one another, in particular in a materially joined manner, such as for example through the use of a high-temperature brazing method. Both the substantially smooth layers and the at least partially structured layers can have, at least in certain areas, microstructures, conductive faces, break-throughs and/or perforations which serve to mix the gas flow better. In particular, an exhaust gas treatment unit is not understood to be a heat exchanger in this case. The exhaust gas treatment units can also be constructed in an exhaust gas return line.

The homogenization of the gas flow before it enters the first exhaust gas treatment unit is advantageously carried out by virtue of the fact that the first exhaust gas treatment unit is constructed relatively close to the second exhaust gas treatment unit, in front of that unit. This brings about homogenization of the gas flow even in the first exhaust gas treatment unit, so that there the conversion rate is improved since the cross section of the first exhaust gas treatment unit has exhaust gas applied to it more uniformly. The volume of the first exhaust gas treatment unit can thus be reduced as compared to a customary structure with the same conversion rate of the pollutants in the exhaust gas. The significantly more efficient conversion rate of the pollutants also improves the conversion rate of the second exhaust gas purification unit, so that as compared to conventional second exhaust gas purification units the latter can, under certain circumstances, be given smaller dimensions.

In order to construct an exhaust gas treatment unit which has only a low back pressure, it is possible to use a honeycomb body with a relatively low cell density, for example less than 200 cpsi (cells per square inch), preferably less than 150 cpsi, particularly preferably 100 cpsi and less. An exhaust gas treatment unit with a relatively high back pressure can include, for example, a honeycomb body with a high cell density of, for example, approximately 800 cpsi, 1000 cpsi or more. Furthermore, the length of the cavities in a honeycomb body influences the back pressure so that an exhaust gas treatment unit with a relatively small back pressure can be constructed through the use of a short honeycomb body, and an exhaust gas treatment unit with relatively high back pressure can be constructed through the use of a long honeycomb body.

In accordance with another feature of the invention, the first distance is selected in such a way that the effect of the first back pressure and of the second back pressure accumulate.

Accumulation is understood herein to mean, in particular, that the back pressure which is present upstream of the first exhaust gas treatment unit is higher than the first back pressure of the first exhaust gas treatment unit. The first back pressure is present therefore if only the first exhaust gas treatment unit has a flow through it without a second exhaust gas treatment unit being provided. The accumulation of the back pressures advantageously brings about a situation in which before the exhaust gas flows into the first exhaust gas treatment unit, it has to overcome a back pressure which is higher than the first back pressure of the first exhaust gas treatment unit. Depending on the configuration of the first and second exhaust gas treatment units, the back pressure is even significantly higher than the first back pressure. Increasing the back pressure causes the flow through the first exhaust gas treatment unit to be homogenized, thus causing the flow of gas through the first exhaust gas treatment unit and the second exhaust gas treatment unit to be homogenized.

In accordance with a further feature of the invention, a second distance between a gas inlet end side of the first exhaust gas treatment unit and a gas inlet end side of the second exhaust gas treatment unit, is less than 60 mm, preferably less than 45 mm, and particularly preferably less than 30 mm.

These values have proven particularly advantageous. In particular, under customary operating conditions the effects of the first and second back pressures are accumulated.

In accordance with an added feature of the invention, the extent of the first exhaust gas treatment unit in the direction of flow is less than 45 mm, preferably less than 35 mm, particularly preferably 25 mm or less.

Due to the very homogeneous and effective conversion of the corresponding substances in the exhaust gas, it is possible to use relatively small first exhaust gas treatment units. In the second exhaust gas treatment unit, it is equally possible to select a relatively small volume since, for example in a case in which the second exhaust gas treatment unit is constructed as a particle filter and the first exhaust gas treatment unit is constructed as an oxidation catalytic converter, the relatively homogeneous flow through the first exhaust gas treatment unit brings about improved supply with the nitrogen dioxide and consequently more homogeneous regeneration, so that a relatively small particle filter volume is sufficient.

In accordance with an additional feature of the invention, the first exhaust gas treatment unit and/or the second exhaust gas treatment unit include at least one honeycomb body.

With a honeycomb body it is possible to provide a first and/or second exhaust gas treatment unit having properties, such as surface, back pressure etc., which can be predetermined very precisely. In particular, metallic or ceramic honeycomb bodies are suitable as the honeycomb bodies. Particle filters can be constructed as honeycomb bodies with at least partially porous channel walls and, if appropriate, channel terminations or corresponding baffle plates and breakthroughs.

In accordance with yet another feature of the invention, the first distance between the first exhaust gas treatment unit and the second exhaust gas treatment unit is less than 15 mm, preferably less than 10 mm and particularly preferably less than 5 mm.

In particular, it is also advantageous to provide both exhaust gas treatment units in a common housing. In this context, the exhaust gas treatment units can be held in corresponding beads, seams or corrugations of the housing through the use of flanging, crimping, beading or the like. It is also possible to fit the second exhaust gas treatment unit flush onto one end side of the heat exchanger. In this context it may be advantageous to allow the exhaust gas to flow transversely, in particular in the last region of the first exhaust gas treatment unit. This can be brought about in honeycomb bodies by providing perforations in the walls of the cavities in the last region, for example in the last 20% or 10% of the length of the first exhaust gas treatment unit. This is particularly advantageous if the second exhaust gas treatment unit includes a particle filter with alternately closed channels. In particular, it is also possible to allow the channel walls to end at different points in the region of the gas outlet end side of the first exhaust gas treatment unit or the gas inlet end side of the second exhaust gas treatment unit, so that a smooth end face is not produced but rather a fissured end face on the first and/or second exhaust gas treatment units, which can also give rise to cross flows, in particular between adjacent channels.

In accordance with yet a further feature of the invention, at least the first exhaust gas treatment unit includes a catalytically active coating.

The catalytically active coating includes, for example, a ceramic wash coat which contains materials that catalyze the desired reactions, that is to say reduce in particular the reaction temperature of these reactions to such an extent that they occur to an appreciable extent at the temperatures in the exhaust. Suitable catalytic converters include, in particular, noble metals such as platinum, rhodium or the like. An oxidation catalytic converter coating catalyzes, in particular, the oxidation of hydrocarbons (HC) or nitrogen oxides ($NO_x$). Furthermore, it is equally possible according to the invention that alternatively or cumulatively, the second exhaust gas treatment unit has a catalytically active coating. For example, the first exhaust gas treatment unit can include a hydrolytic catalytic converter while the second exhaust gas treatment unit includes an SCR catalytic converter.

In accordance with yet an added feature of the invention, the ratio of the first back pressure to the second back pressure is greater than 2, preferably greater than 10.

In particular, with these back pressure conditions, that is to say when the back pressure of the second exhaust gas treatment unit is greater than the back pressure of the first exhaust gas treatment unit by a factor of 2 or even 10, the effects of the first back pressure of the heat exchanger and of the second back pressure of the exhaust gas treatment unit already accumulate in a particularly advantageous way at the first intervals of 15 mm or less.

In accordance with a concomitant feature of the invention, the second exhaust gas treatment unit includes at least one of the following components:

(a) an open particle filter;

(b) a closed particle filter; and (c) an SCR catalytic converter.

All of these three possible second exhaust gas treatment units (a), (b) and (c) constitute components with a relatively high back pressure.

An open particle filter can be distinguished by the fact that a particle, in particular a particle of soot, can basically pass through it without having been intercepted by a channel wall. In a closed particle filter, this is not possible since it has channels which are generally alternately closed so that therefore in a subset of the channels, the exhaust gas can only flow in but cannot leave the channel again through a usual channel opening, but rather the exhaust gas must flow through the porous walls of the filter instead, as a result of which it passes into another subset of channels which in turn do not have an inlet-end free flow cross section but rather only an outlet-end free flow cross section. In the case of closed particle filters, it is basically not possible for a relatively large particle to pass through the filter if the filter is intact, since the particle becomes stuck in the porous channel wall. This is basically possible in an open filter system. An open particle filter has porous regions at least in one part of its walls.

For example, it is possible to provide an open or closed particle filter as a second exhaust gas treatment unit, upstream of which filter an oxidation catalytic converter is connected as a first exhaust gas treatment unit, so that the particle filter is continuously regenerated by virtue of the fact that in the oxidation catalytic converter nitrogen monoxide is oxidized to form nitrogen dioxide which can be used to burn the particles of soot. According to the invention, the oxidation catalytic converter can be made smaller than if the distance between the two exhaust gas treatment units is not selected according to the invention. In particular, if a closed particle filter, for example a diesel particle filter having a structure which is known per se is provided as a second exhaust gas treatment unit and a honeycomb body is provided as a first exhaust gas treatment unit and the distance which is selected between them is made as small as possible, if appropriate even close to zero, by applying the end side of the honeycomb body to the corresponding end side of the particle filter, it is advantageous to provide perforations and/or, if appropriate, baffle plates in the end region of the channel walls of the first exhaust gas treatment unit. Such baffle plates favor further mixing of the exhaust gas.

A further example is a honeycomb body with a high cpsi and with an SCR coating as second exhaust gas treatment unit, in front of which a honeycomb body with a low cpsi and with a coating which promotes the hydrolysis of urea, is disposed.

Other features which are considered as characteristic for the invention are set forth in the appended claims.

Although the invention is illustrated and described herein as constructed in an exhaust gas system with two exhaust gas treatment units, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
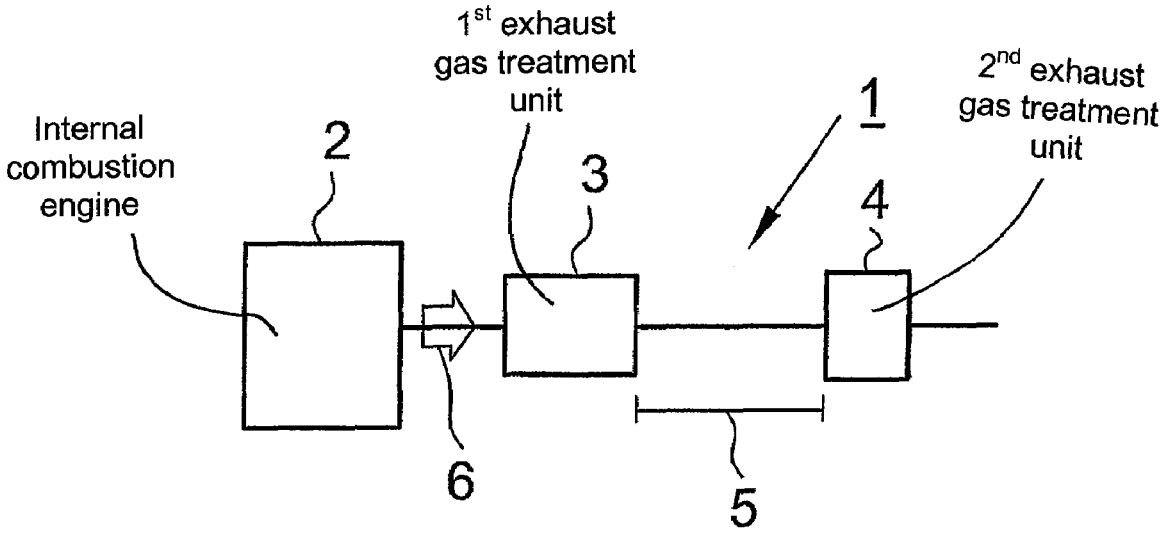
FIG. 1 is a block diagram of an exemplary embodiment of an exhaust gas system according to the invention.

Referring now to the figures of the drawings in detail and first, particularly, to FIG. 1 thereof, there is seen a block diagram of an exemplary embodiment of an exhaust gas system 1 according to the invention, for an internal combustion engine 2, which includes a first exhaust gas treatment unit 3 and a second exhaust gas treatment unit 4. The first exhaust gas treatment unit 3 is constructed as a closed particle filter with alternately closed channels or passages, while the second exhaust gas treatment unit 4 is constructed as a honeycomb body with a catalytically active coating which catalyzes the conversion of nitrogen monoxide to nitrogen dioxide, although the invention is not restricted thereto. The particle filter can be constructed as a ceramic unsupported extrudate or else it can be correspondingly constructed from metallic layers. The first exhaust gas treatment unit 3 has a first hydrodynamic back pressure, while the second exhaust gas treatment unit 4 has a second back pressure which is higher than the first back pressure.

According to the invention, the first exhaust gas treatment unit 3 is constructed at a first distance 5 upstream of the second exhaust gas treatment unit 4, in the direction of flow, such that during operation, a flow 6 of gas which is symbolized by an arrow and which passes into the first exhaust gas treatment unit 3, is homogenized. The first distance 5 in this case is, in particular, less than 15 mm, preferably less than 10 mm and particularly preferably less than 5 mm. The first exhaust gas treatment unit 3 and the second exhaust gas treatment unit 4 are constructed in such a way that at this first distance 5, the effects of the first back pressure and of the second back pressure are accumulated, so that the exhaust gas which flows into the first exhaust gas treatment unit 3 has to overcome a back pressure which is higher than the first back pressure of the first exhaust gas treatment unit 3. As explained above, this leads to homogenization of the flow 6 of gas which flows into the first exhaust gas treatment unit 3.

Figure 2:
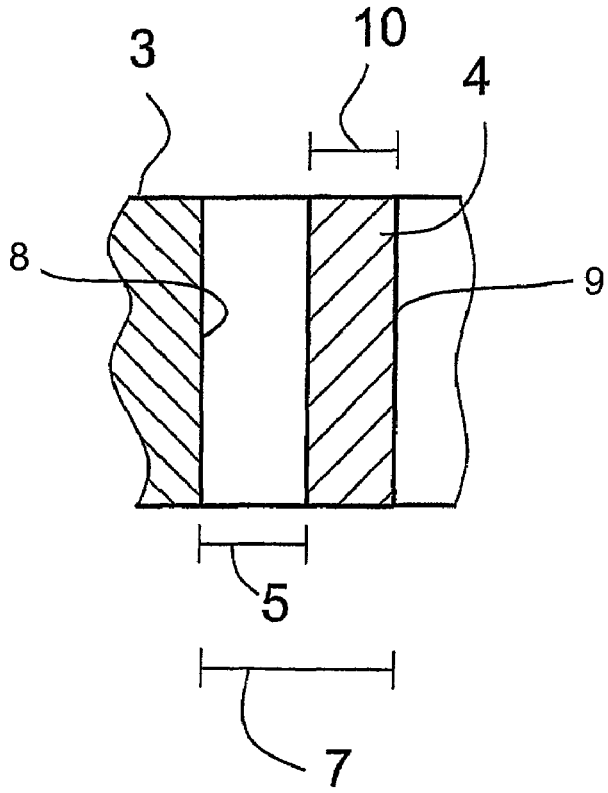
FIG. 2 is a fragmentary, diagrammatic, partially sectional view of the exemplary embodiment of an exhaust gas system according to the invention.

FIG. 2 is a fragmentary, diagrammatic view of the exhaust gas system 1, which includes the first exhaust gas treatment unit 3 and the second exhaust gas treatment unit 4. A second distance 7 between a gas inlet end side 8 of the first exhaust gas treatment unit 3 and a gas inlet end side 9 of the second exhaust gas treatment unit 4, is selected according to the invention in such a way that the flow is homogenized in the first exhaust gas treatment unit 3. In particular, the second distance 7 is less than 60 mm, preferably less than 45 mm and particularly preferably less than 30 mm. In particular, short honeycomb bodies can be used as the first exhaust gas treatment unit 4, in particular with an extent 10 in the direction of flow of approximately 20 to approximately 40 mm. The first distance 5 is, for example, less than 15 mm, or else 5 mm or less. In particular, the first distance 5 is selected in such a way that the effect of the first back pressure of the first exhaust gas treatment unit 3 and of the second back pressure of the second exhaust gas treatment unit 4 accumulate, so that the exhaust gas which flows into the first exhaust gas treatment unit 3 has to overcome a back pressure which is higher, preferably significantly higher, than the second back pressure of the first exhaust gas treatment unit 3 alone.

Figure 3:
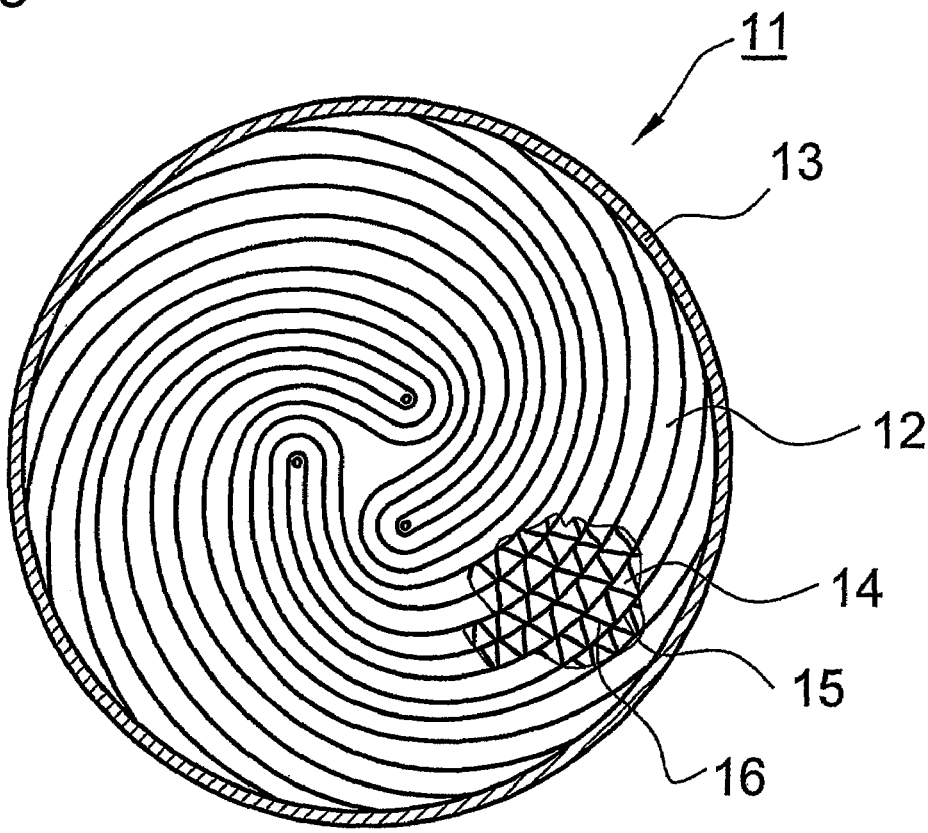
FIG. 3 is a cross-sectional view of a honeycomb body.

FIG. 3 is a diagrammatic view of an example of a honeycomb body 11 in cross section, which can be constructed as a first exhaust gas treatment unit 3 and/or a second exhaust gas treatment unit 4. This honeycomb body 11 includes a honeycomb structure 12 in an outer casing tube 13. The honeycomb structure 12 has cavities 14 into which or through which a fluid can flow and which are formed by substantially smooth layers 15 and at least partially structured layers 16. At least one at least partially structured layer 16 and, if preferable, at least one substantially smooth layer 15, are wound or stacked and one or more stacks are wound in the same direction or in opposite directions. Substantially smooth layers 15 can have microstructures with amplitudes which are smaller than the structuring amplitudes of the at least partially structured layer 16. The layers 15, 16 are preferably metallic layers, in particular sheet metal layers and/or metallic fiber layers, which can be manufactured, in particular, from high-temperature-resistant and corrosion-resistant materials such as, for example, Al or Cr steels. The layers 15, 16 can have microstructures, perforations, break-throughs and/or baffle plates.

Figure 4:
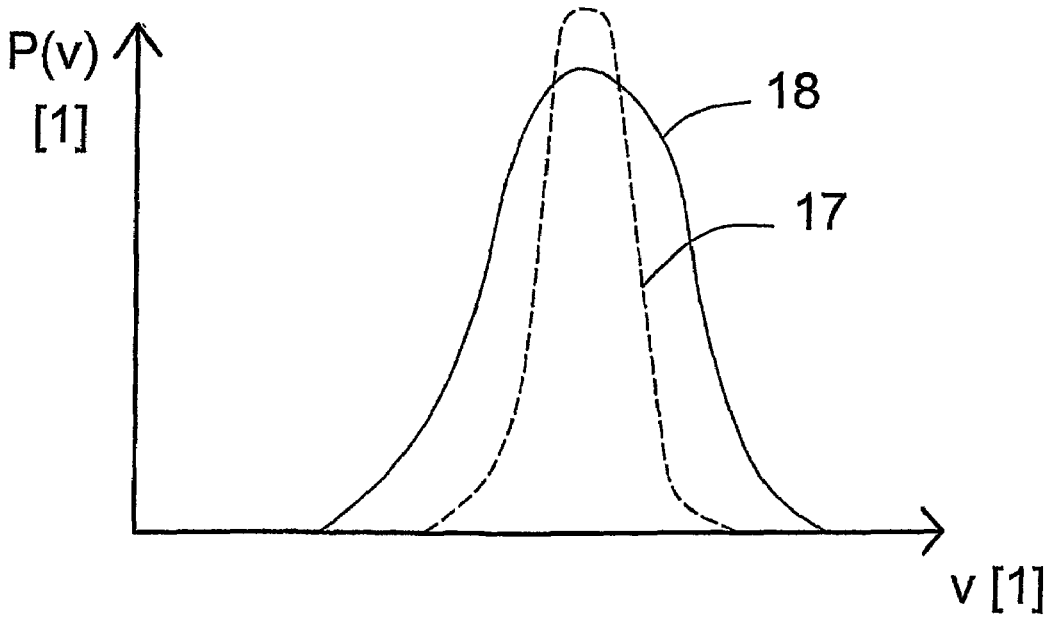
FIG. 4 is a graph showing probability distributions of flow rates.

FIG. 4 is a graph of a first probability distribution 17 of a velocity v and a second probability distribution 18 of the velocity v. The first probability distribution 17 is obtained if gas is made to flow through only the first exhaust gas treatment unit 3, that is to say without a second exhaust gas treatment unit 4 being formed downstream thereof in the direction of flow. The probability of a specific velocity being present in the gas is plotted in this case for both distributions. Both the probability and the velocity are given in relative units. The second probability distribution 18 is the probability distribution in a system according to the invention. It therefore relates to an exhaust gas system 1 with a first exhaust gas treatment unit 3 and a second exhaust gas treatment unit 4. The second probability distribution 18 is wider and has, in particular, a greater width with half the maximum height (full width half maximum) than the first probability distribution 17. This is based on the homogenization of the flow according to the invention.

The exhaust gas system 1 according to the invention advantageously permits systems with two exhaust gas treatment units 3, 4 to be formed, in which the exhaust gas treatment units 3, 4 are disposed one behind the other in the direction of flow. As a result of the homogenization of the flow, the first exhaust gas treatment unit 3 and/or the second exhaust gas treatment unit 4 can be made smaller. This applies, for example, if the first exhaust gas treatment unit 3 is constructed as an oxidation catalytic converter and the second exhaust gas treatment unit 4 is constructed as a particle filter. The homogenization of the flow into the first exhaust gas treatment unit 3 increases the conversion rate so that the first exhaust gas treatment unit 3 and/or the second exhaust gas treatment unit 4 can be made smaller. This saves considerable costs when configuring such systems.

The invention claimed is:

1. An exhaust gas system for an internal combustion engine, the exhaust gas system comprising:

a first exhaust gas treatment unit with a first back pressure; and a second exhaust gas treatment unit with a second back pressure being higher than said first back pressure;

said first exhaust gas treatment unit being disposed at a first distance upstream of said second exhaust gas treatment unit, in exhaust gas flow direction, causing a gas flow entering said first exhaust gas treatment unit during operation to be homogenized, said first distance being configured for causing an effect of said first back pressure and of said second back pressure to accumulate, and said first distance between said first exhaust gas treatment unit and said second exhaust gas treatment unit being less than 15 mm.

2. The exhaust gas system according to claim 1, wherein said first exhaust gas treatment unit has a gas inlet end side, and said second exhaust gas treatment unit has a gas inlet end side spaced from said gas inlet end side of said first exhaust gas treatment unit by a second distance of less than 60 mm.

3. The exhaust gas system according to claim 1, wherein said first exhaust gas treatment unit has a gas inlet end side, and said second exhaust gas treatment unit has a gas inlet end side spaced from said gas inlet end side of said first exhaust gas treatment unit by a second distance of less than 45 mm.

4. The exhaust gas system according to claim 1, wherein said first exhaust gas treatment unit has a gas inlet end side, and said second exhaust gas treatment unit has a gas inlet end side spaced from said gas inlet end side of said first exhaust gas treatment unit by a second distance of less than 30 mm.

5. The exhaust gas system according to claim 1, wherein said first exhaust gas treatment unit has an extent, in said exhaust gas flow direction, of less than 45 mm.

6. The exhaust gas system according to claim 1, wherein said first exhaust gas treatment unit has an extent, in said exhaust gas flow direction, of less than 35 mm.

7. The exhaust gas system according to claim 1, wherein said first exhaust gas treatment unit has an extent, in said exhaust gas flow direction, of 25 mm or less.

8. The exhaust gas system according to claim 1, wherein said first distance between said first exhaust gas treatment unit and said second exhaust gas treatment unit is less than 10 mm.

9. The exhaust gas system according to claim 1, wherein said first distance between said first exhaust gas treatment unit and said second exhaust gas treatment unit is less than 5 mm.

10. The exhaust gas system according to claim 1, wherein at least one of said exhaust gas treatment units includes at least one honeycomb body.

11. The exhaust gas system according to claim 1, wherein at least said first exhaust gas treatment unit includes a catalytically active coating.

12. The exhaust gas system according to claim 1, wherein said first back pressure and said second back pressure are in a ratio greater than 2.

13. The exhaust gas system according to claim 1, wherein said first back pressure and said second back pressure are in a ratio greater than 10.

14. The exhaust gas system according to claim 1, wherein said second exhaust gas treatment unit includes at least one component selected from the group consisting of:

(a) an open particle filter;

(b) a closed particle filter; and (c) an SCR catalytic converter.

* * * * *